US006065751A

United States Patent [19]

Armstrong

[11] Patent Number: 6,065,751

[45] Date of Patent: May 23, 2000

[54] BOARD GAME RETAINER FOR THE GAME OF GO

[76] Inventor: David Garvin Armstrong, 242 Simpson's Point Rd., Brunswick, Me. 04011

[21] Appl. No.: 09/070,182

[22] Filed: Apr. 30, 1998

[51] Int. Cl.[7] ..... A63F 3/00

[52] U.S. Cl. ..... 273/271; 273/282.3; 273/287

[58] Field of Search ..... 273/236, 282.1, 273/282.3, 287, 271, 148 R, 309

[56] References Cited

U.S. PATENT DOCUMENTS

| | | |
|---|---|---|
| 303,991 | 8/1884 | Dribble . |
| 2,511,774 | 6/1950 | Goldsmith . |
| 3,210,080 | 10/1965 | Rael . |
| 3,236,523 | 2/1966 | Stein . |
| 3,584,874 | 6/1971 | Clark . |
| 3,588,112 | 6/1971 | Holt . |
| 3,727,916 | 4/1973 | Miller . |
| 3,784,205 | 1/1974 | Cross . |

*Primary Examiner*—William M. Pierce
*Attorney, Agent, or Firm*—Martin S. Chizek

[57] ABSTRACT

A retainer for the game of Go so configured that when the retainer is secured over a board on which a game is in progress, each stone on the board is constrained to remain in its proper position. Retention means are provided for holding the retainer and the playing board together reliably so that they can be moved about, placed on edge for storage, etc., as may be convenient. Integral means are provided for indicating which side has the next turn, the color and the net number of the captured stones, and the intersection, if any, on which immediate play is forbidden because of an active "ko".

8 Claims, 8 Drawing Sheets

BOARD GAME RETAINER FOR THE GAME OF GO

BACKGROUND OF THE INVENTION

There are a class of games called board games including, in particular, games such as checkers, chess, Go, backgammon, monopoly, shogi, etc., whose play involves the use of a flat game board, suitably marked, and of playing pieces, men, counters, etc., which are placed on the game board and whose positions on the board indicate the condition and progress of the game. There are a number of such games, which, if played seriously, are likely to require more time than may be available in a single session. Notable among these are chess and Go. If a game is adjourned before completion, to be completed at a later time, it is necessary to assure that the positions of the pieces on the board can be preserved in the interim or accurately restored when the game is resumed.

In chess, it is easy to record a position—either graphically or using Forsyth notation—and to set up the same position at the start of a subsequent session. Moreover, there are magnetic and peg-in chess sets, which are fairly satisfactory to use, and which retain a position between playing sessions reasonably securely. A retainer for chess, analogous to the invention disclosed herein, could be constructed in the form of a thin flat rigid sheet of suitable material joined to (or fabricated integrally with) a set of nine vertical and nine horizontal partitions intersecting to provide an array of sixty-four cells of square cross section, corresponding to the sixty-four squares of the chess board, the cells being of a depth sufficient to accommodate the kings (and hence, any of the men) and the array being placed over the chess board and held in place with clips or other retention devices. Such a retainer is one of the features of Goldsmith, U.S. Pat. No. 2,511,774, where it is used, apparently, in combination with chess men specially modified to be much shorter than normal and of uniform height. A similar retainer for use with chess men of normal design would be bulky and awkward to use and to store when not in use, and since, as noted above, it is not much needed, it would probably achieve very little acceptance in the marketplace.

With Go, however, the situation is very different. An understanding of this difference and of the usefulness of this invention requires some knowledge of the game and of the equipment with which it is played. Go is a game of strategy and tactics, with no inherent element of chance, played between two players. A Go board is rectangular, its width being approximately nine-tenths of its length, so that from the perspective of the players looking down at it, it appears to be approximately square. It is of uniform background color and is marked with nineteen evenly spaced vertical lines intersected by nineteen evenly spaced horizontal lines, so that there are three hundred and sixty-one points of intersection, including those along the outer edges. The playing pieces, called "stones", are all of the same shape and nearly the same size and are of two colors—black for one player and white for the other. They are disc-like, having, for use on a standard sized playing board, a diameter of about 22 millimeters and a thickness at the center of from 6 to 10 millimeters, each increase of a millimeter in thickness corresponding to a very significant increase in the cost of a set of stones. Both top and bottom surfaces are convex, so they are much thinner at the outer circumference than at the center. They are ordinarily kept in bowls, from which the players withdraw them one at a time to be played down onto the board. The covers of the bowls may be inverted and used to hold any stones of the opposite color which are captured in the course of the game.

At the start of a game, the board is empty (unless a small number of handicap stones are placed in prescribed positions for the benefit of the weaker of the two players) and the players alternate in placing stones of their own color onto the board—placing them not in the rectangles formed by the intersecting lines but on the points of intersection. A stone, once placed, is not moved until the end of the game, unless it is captured. With good play on both sides, relatively few stones will be captured, so if a game is adjourned to be completed later, there may well be over two hundred stones on the board. Obviously, it would be impractical to record the position and clear the board, since setting up the position again for a subsequent session, with due care to replace each stone in its correct position, might well take more time than had been spent in playing the stones originally.

Magnetic Go sets have been manufactured and sold, but they are not very satisfactory. At the end of a game, the stones are rearranged so that the territories surrounded and controlled by the two players are reshaped into rectangular areas for easy counting; magnetic stones tend to interact in unpredictable ways when this is done. They also cling to each other in the bowl from which they are taken in play and this makes the handling of them awkward and unpleasing.

The game could be played with pencil and paper, or with felt "stones" on a felt board, but to most Go players such means of play would be altogether unsatisfactory. The size and shape of the board and stones and the materials from which they are made are a part of a tradition established through thousands of years of play. Go is an integral part of the culture of the societies in which it is played; verbal expressions relating to the game are used metaphorically in ordinary conversation, even by non-players. A familiar feature of the game is the sound of its being played—unlike chess where the men have felt-covered bases and the play is expected to be entirely silent. The best Go boards are hollowed out underneath to impart a resonance to the cheerful click of the stones as they are placed down onto the board with characteristic vigor. An acceptable retainer will not require modifying the appearance or the nature of the stones or of the playing surface.

Another feature of the game is related to a general antipathy to exact symmetry. The stones are usually placed on the board without any effort to locate them precisely over an intersection and, since the diameter of the stones is slightly greater than the spacing of the vertical lines on the board, a horizontal line of adjacent stones must necessarily overlap a bit. Hence, an acceptable retainer for Go cannot use a structure with solid vertical and horizontal intersecting partitions dividing the playing space into three hundred and sixty-one entirely separate cells. When a retainer is placed over the board, it will be acceptable if the stone, are nudged slightly toward being better centered over their intersections, but preferably their positions should not be too severely regularized and it is essential that adjacent stones be permitted to overlap slightly. It is highly desirable for the top surface of the retainer to be transparent, so that both players can observe that no stones are inadvertently shifted to different positions as the retainer is being placed over the playing board and so that the game can be studied between playing sessions without removing the retainer.

Although the Go boards and stones used in tournaments and in most casual games are standardized in dimensions and in the number of vertical and horizontal lines (19 by 19), smaller boards (13 by 13 or 9 by 9) are often used in teaching beginning players, or to shorten the time required to play a game. It is unlikely that a game played on a board of reduced size would require more than one playing session, but retainers for such boards could be considered if there appeared to be a need for them.

When a game of Go is adjourned, to be completed later, there are certain items of information (in addition to the positions of the black and white stones on the board) which need to be retained. First, it is necessary to know whether it is the player with the black or the white stones whose turn it is to place the next stone. Second, there may be stones of either color, or both, which have been captured. It is not the absolute number of such stones but rather the excess of one color over the other which is significant. Thus, for example, if fifteen black and five white stones have been captured then a net count of ten black captured stores should be recorded. Third, there may be one particular intersection on the board on which the player whose turn it will be when the game is resumed is forbidden to place a stone, by reason of "ko"—a situation well known to Go players. Although these three items of information could be recorded on paper, a desirable feature for a Go retainer would be the incorporation of means for preserving this information—preferably in a way which does not add appreciably to the bulk of the retainer and which is easy to use but not obtrusive or displeasing in appearance.

OBJECTIVES OF THE INVENTION

In view of the foregoing considerations, it is the primary object of this invention to provide a retainer for the game of Go so configured that when the retainer is secured over a board on which a game is in progress, each stone on the board is constrained to remain in its proper position.

It is a further object of this invention to provide retention means for holding the retainer and the playing board together reliably so that they can be moved about, placed on edge for storage, etc., as may be convenient. This retention means should be easy to engage and to release when the playing board is in its normal playing position on a table or other flat surface. It should not entail any modification of the top surface of the playing board.

It is a further object of this invention to provide, as an integral part of the retainer, means for indicating which side has the next turn, the color and the net number of the captured stones, and the intersection, if any, on which immediate play is forbidden because of an active "ko".

SUMMARY OF THE INVENTION

The foregoing objects are achieved, generally, in a retainer comprising a frame which can be secured to the playing board, a generally planar sheet having a top surface, bottom surface, and four peripheral edges enclosed and contained by the frame, and a plurality of cylindrical members or pegs, disposed upon the planar sheet bottom surface, each cylindrical member having a distal end projecting perpendicularly from the bottom surface, whereby when the cylindrical member distal ends are brought near to, or into communication with, the playing surface, the playing pieces are constrained among the plurality of cylindrical members such that the configuration of the playing pieces upon the playing surface is maintained during storage and transport of the playing board.

BRIEF DESCRIPTION OF THE DRAWING

A preferred embodiment of this invention is shown, for purposes of illustration and description, in the accompanying drawings, forming a part of the specification, wherein.

DETAILED DESCRIPTION OF THE INVENTION

Figure 1:
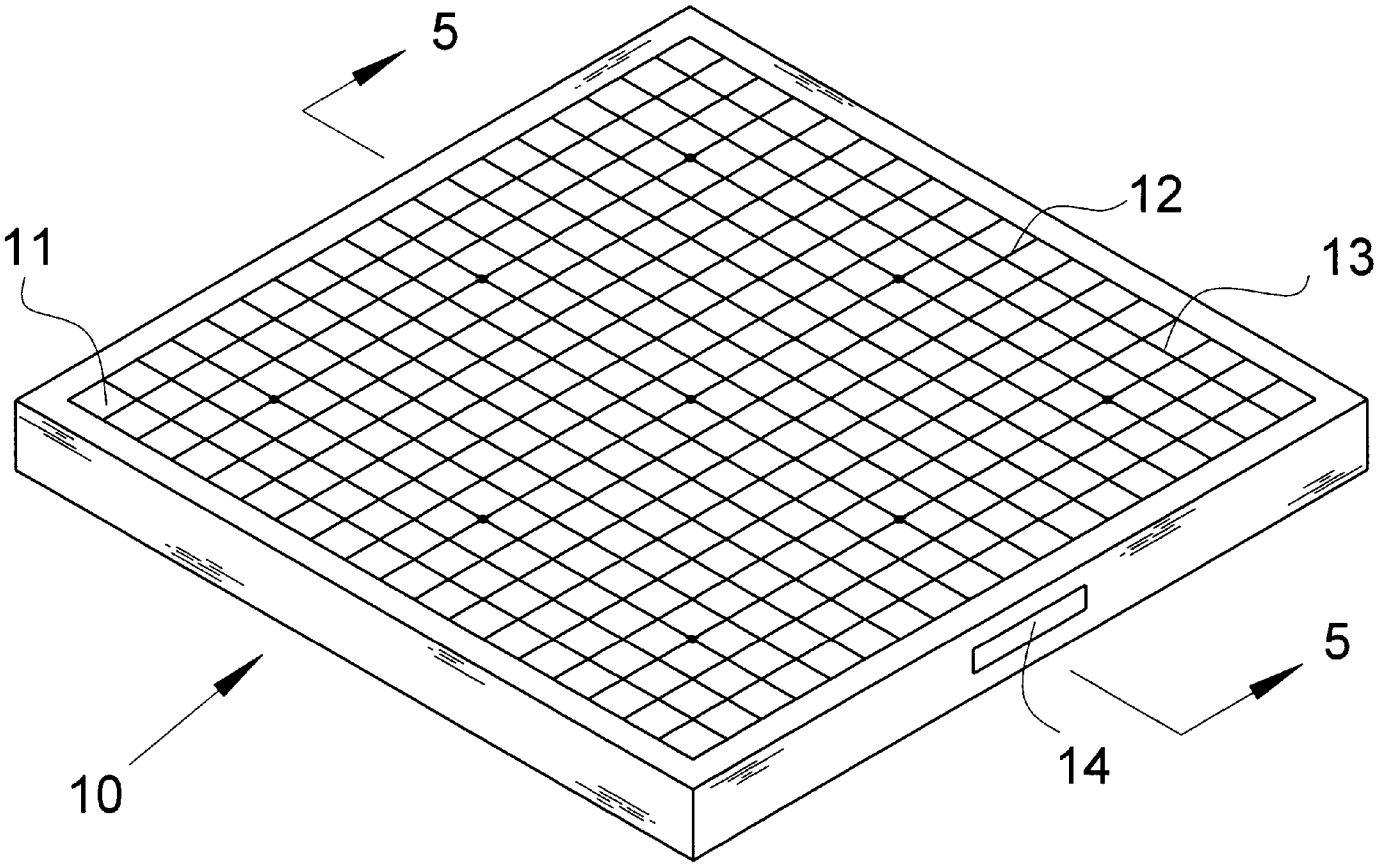
FIG. 1 is a perspective view of a Go playing board.

Referring to the drawings, FIG. 1 shows a Go playing board 10 having a flat playing surface 11 of uniform background color on which are marked nineteen straight parallel evenly spaced vertical lines 12 intersected by nineteen straight parallel evenly spaced horizontal lines 13, so that there are 361 points of intersection. Recesses 14 in two opposite edges of the four outside edges of the playing board permit insertion of retention latches (25 in FIG. 2).

Figure 2:
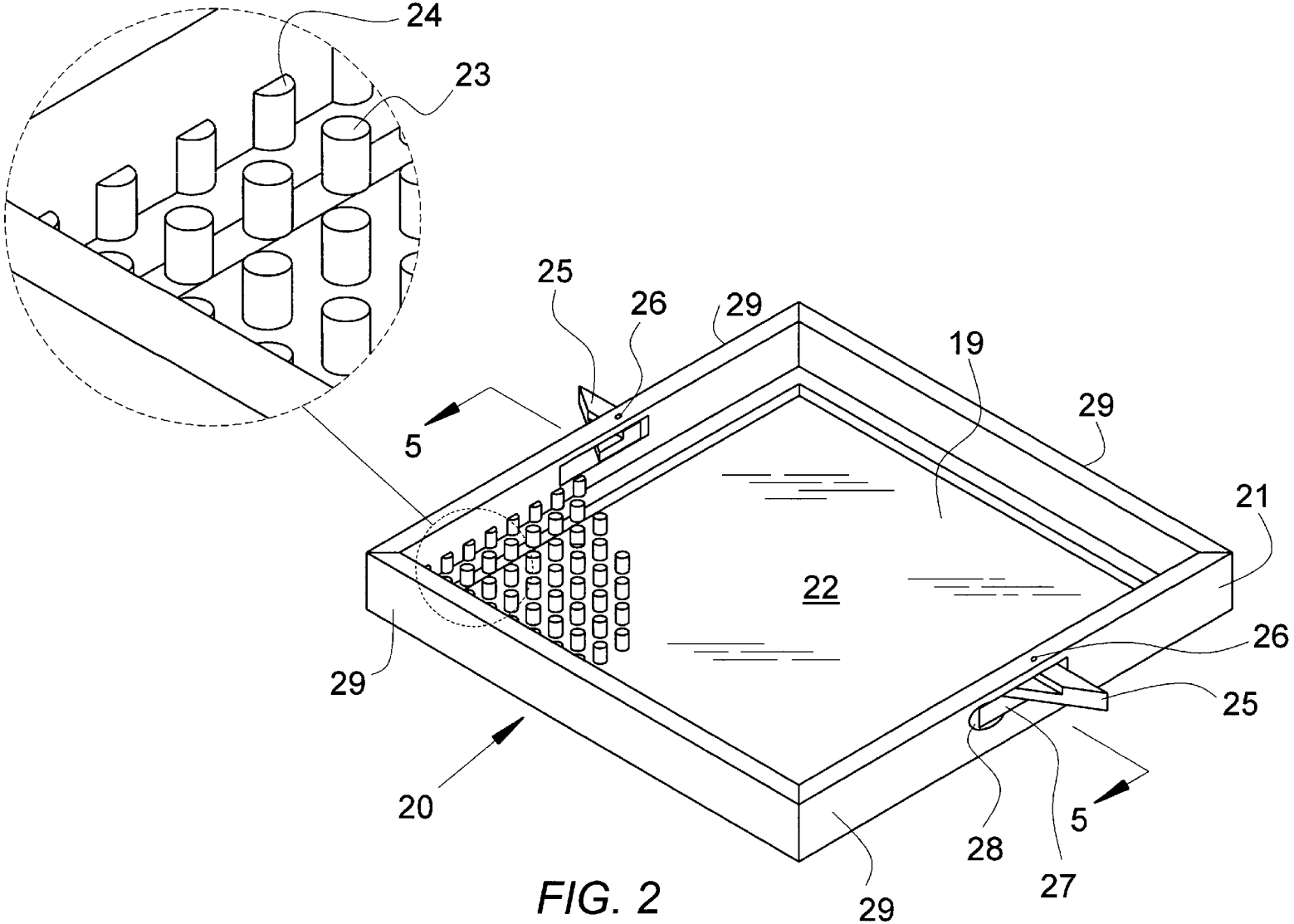
FIG. 2 is a perspective view of the retainer, inverted to show interior details.

FIG. 2 shows the retainer 20 which is the subject of this invention, being designed for use in conjunction with the playing board 10 of FIG. 1. This retainer is made up of a frame 21 with four peripheral edges 29, a top 22 with a top surface 17 and a bottom surface 19, said top being a thin, flat, rigid sheet of material which, preferably, is transparent and clear, enclosed and contained by the frame 21, a number (normally 324, in an eighteen by eighteen array) of cylindrical members, or pegs, 23 which are attached to the top 22 or fabricated integrally with it and which project downward from the top by a distance slightly greater than the maximum thickness of the stones which may be used in play, an additional number (normally seventy-two) of half-pegs 24, positioned at the outer ends of the rows and columns of the array, and two retention latches 25, the securing ends of which can be moved through an angle of approximately ninety degrees about pivots 26 so as to be engaged or disengaged with the two recesses 14 in the playing board 10. Since the playing board and the retainer are not quite square but have sides about ten percent longer than their ends, the retainer can be brought down over the board in only two orientations, 180° apart. The recesses 14 are of sufficient length to accommodate the latches 25 for either orientation.

Figure 3:
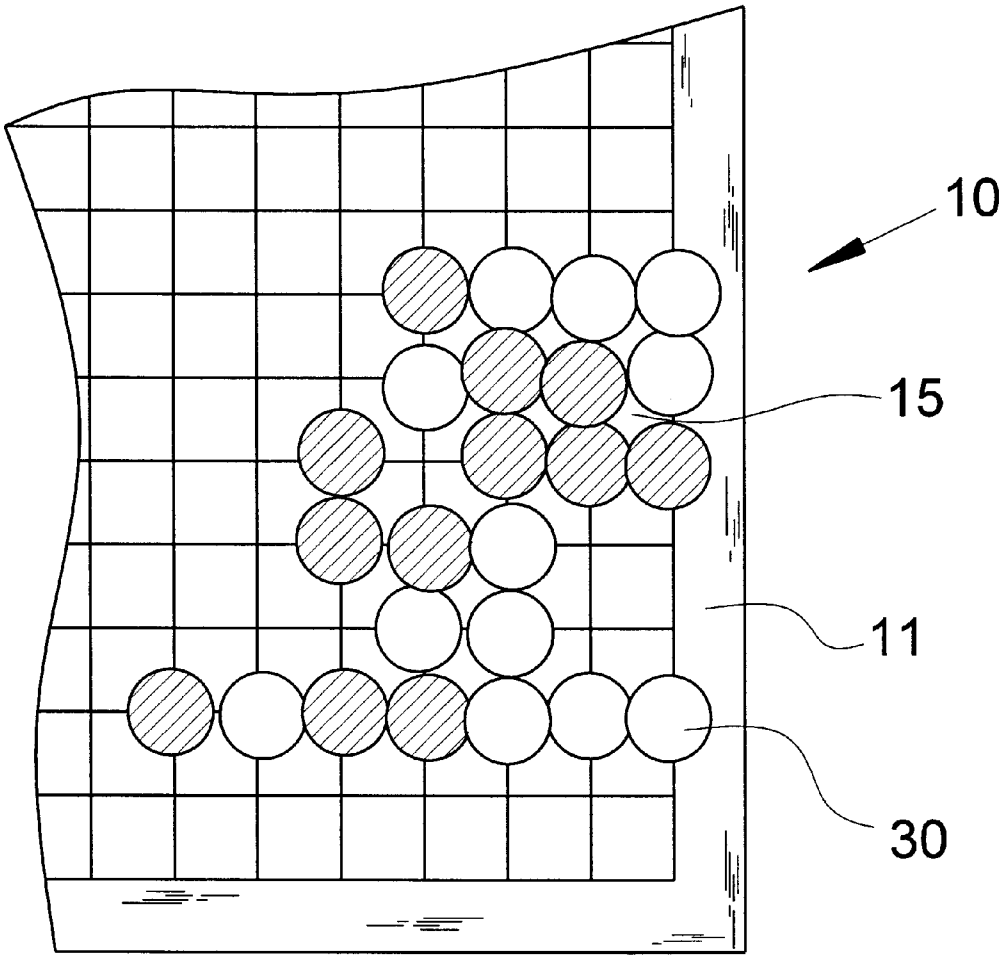
FIG. 3 is a partial plan view of the playing board (without the retainer) with a number of black and white stones in place on the board.

In FIG. 3, a number of playing stones 30 are shown as they have been placed on the playing surface 11 of a segment of the playing board 10. It is particularly significant that horizontally adjacent stones are so crowded—especially where there is a fairly long line of them, as on the third line up from the bottom of the board—that they could not be held in place by a system of closed cells in which each stone would be entirely surrounded by solid walls. Even when the stones are densely packed, however, there are among them small spaces 15, having a four-cusped shape, into which cylindrical members, or pegs, may be inserted. Four such pegs around a particular stone constitute a cell which will keep that stone from moving away from the particular intersection onto which it has been played. A full array of such pegs will keep all of the stones in their respective places, each in its own cell.

Figure 4:
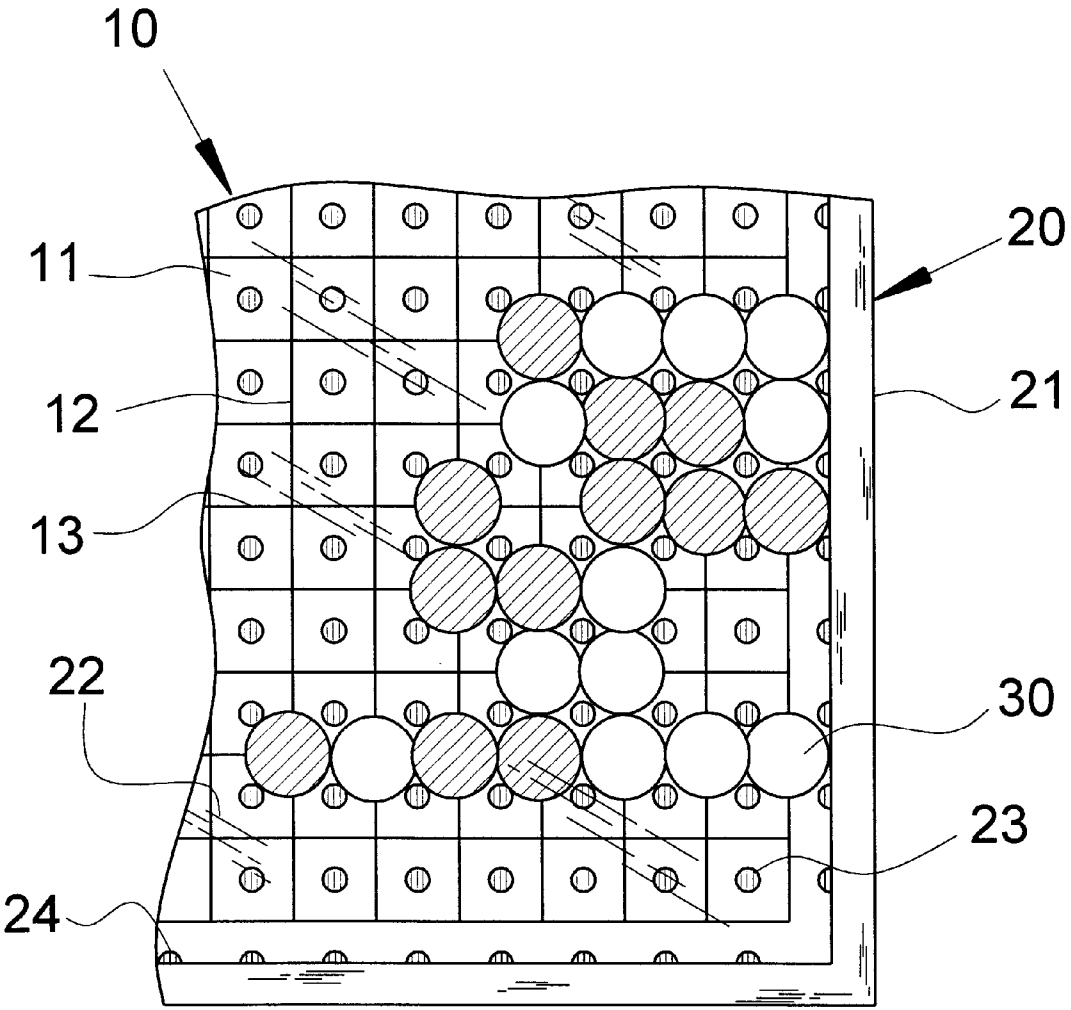
FIG. 4 is a partial plan view of the playing board with the retainer in place; the same stones as in FIG. 3 are visible through the transparent top of the retainer.

FIG. 4 shows the same segment of the playing board 10 as in FIG. 3, with the same stones 30 in the same positions, but with the retainer 20 in place. The intersecting lines 12, 13 on the playing surface 11, the stones 30, and the pegs 23, 24 which are a part of the retainer 20, are all visible through the transparent top 22 of the retainer. Note that each stone has some freedom of position within its cell and that adjacent stones can overlap slightly.

Figure 5:
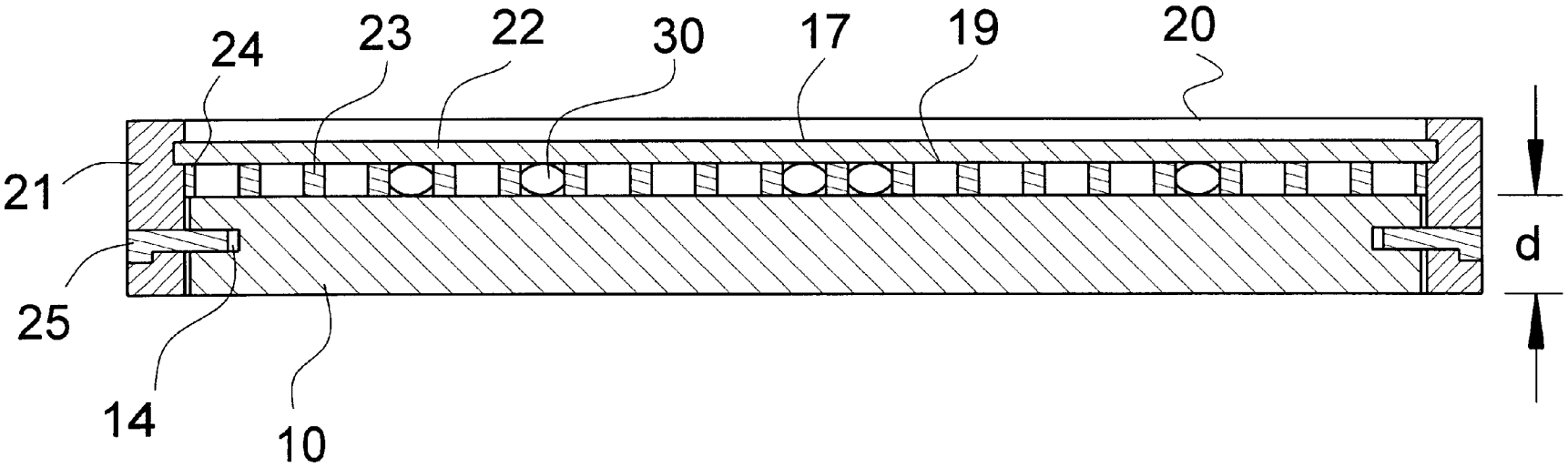
FIG. 5 is a cross-sectional view of the playing board with a few stones in place and with the retainer secured to the playing board with retention latches, taken along a line through the centers of the retainer pegs in a horizontal row adjacent to the horizontal centerline of the playing board.

In FIG. 5, the walls of the frame 21 of the retainer 20 extend beyond the distal ends of the pegs 23, 24 by a distance "d" that exceeds the maximum thickness of a playing stone 30, so that, as the retainer is being lowered into position over the playing board, the retainer is brought into proper register with the board before the distal ends of the pegs insinuate themselves among the stones. If a particular stone has been placed so far from being perfectly centered over the intersection on which it was played as to exceed the range of position permitted within its cell in the retainer, then one or two of the retainer pegs will impinge on the edge of the stone as the retainer is being put into place. Because of the convex shape of the top of the stone, this will result in a horizontal component of force against the stone. Because of the convex shape of the bottom of the stone, if it does not immediately move horizontally, it will be tipped, increasing the horizontal component of force against it. Hence, all such stones will be nudged into their proper positions within their cells in the retainer as the retainer is brought into its final position. (Notice, for example, that the three stones on the fifth line up from the bottom of the board, in FIG. 4, have been moved to the right from their positions in FIG. 3.) The edges of the distal ends of the pegs should, preferably, be rounded slightly to permit the pegs to come readily into place among the stones.

Figure 7:
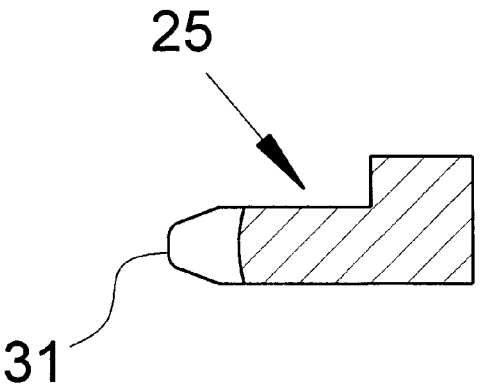
FIG. 7 is a cross-sectional view of a retention latch.
Figure 6:
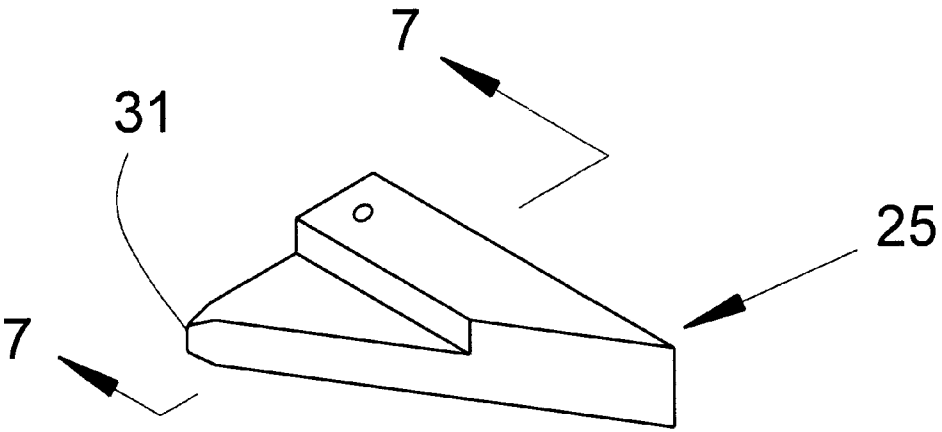
FIG. 6 is a perspective view of a retention latch.
Figure 8:
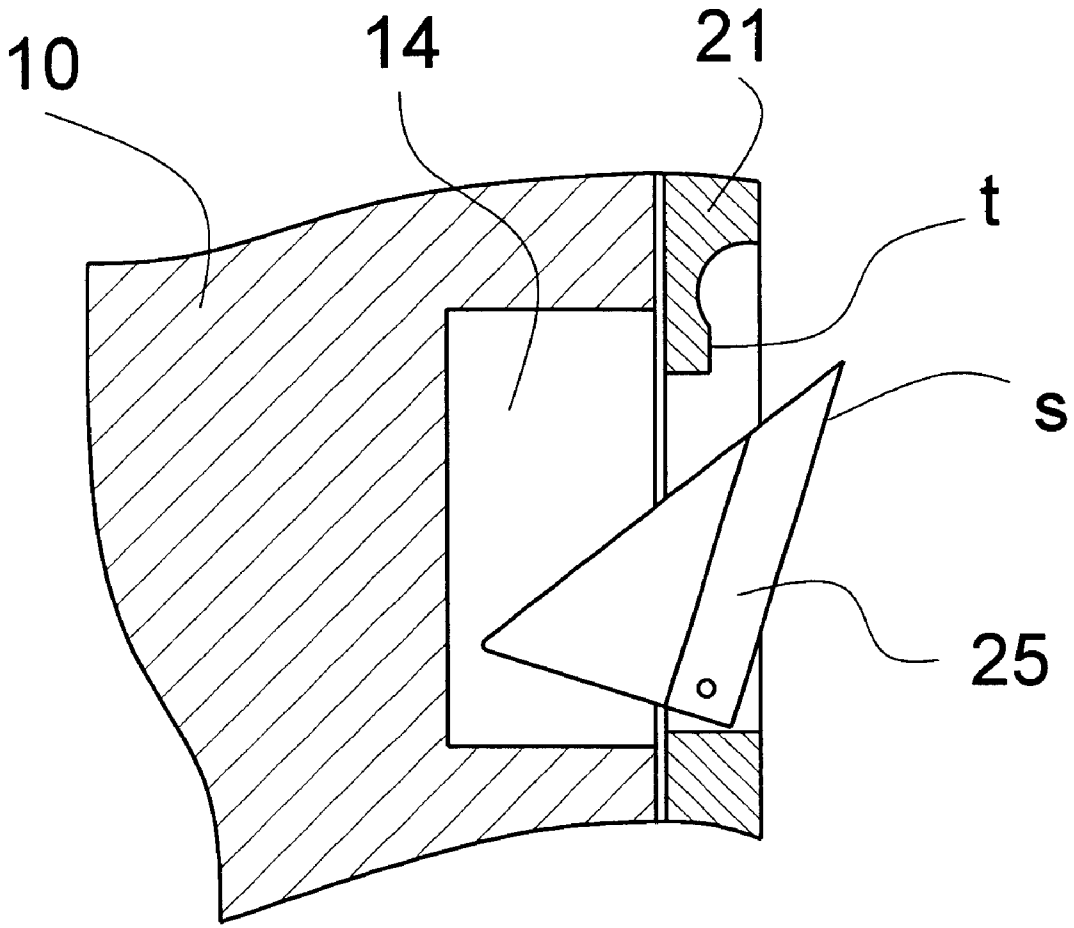
FIG. 8 is a cross-sectional view of a part of the playing board and retainer, showing a retention latch partially closed.

It is desirable for the recesses 14 in the edges of the playing board 10 to be fairly narrow, consistent with there being sufficient strength in the portion of the latches 25 which engage them. However, the portion of the latches which is visible when they are closed should be rather wider, so as to be visually harmonious with the thickness of the frame 21, and so as to make the latches easy to operate. Hence the latch, shown in perspective in FIG. 6, should have a cross-section (FIG. 7) which is L-shaped, as shown, or T-shaped, so as to provide the desired difference in thickness. The leading edges 31 of the latches should preferably be tapered, as shown in FIGS. 6 and 7, to facilitate entry into the recesses in the playing board. Referring to FIG. 2, the slots 27 in the sides of the retainer frame 21 in which the latches 25 are mounted, are terminated, at the end opposite the pivot end, in hemispherical recesses 28 to permit entry of a fingertip to open the latches. Referring to FIG. 8, there is shown a cross-section of a portion of the playing board 10 and the retainer frame 21 with a latch 25 shown in a partially closed position. The thickness "t" of the part of the frame against which the latch comes to rest in its fully closed position is such that the surface "s" of the latch is flush with the outer surface of the retainer frame when the latch is fully closed.

Figure 9:
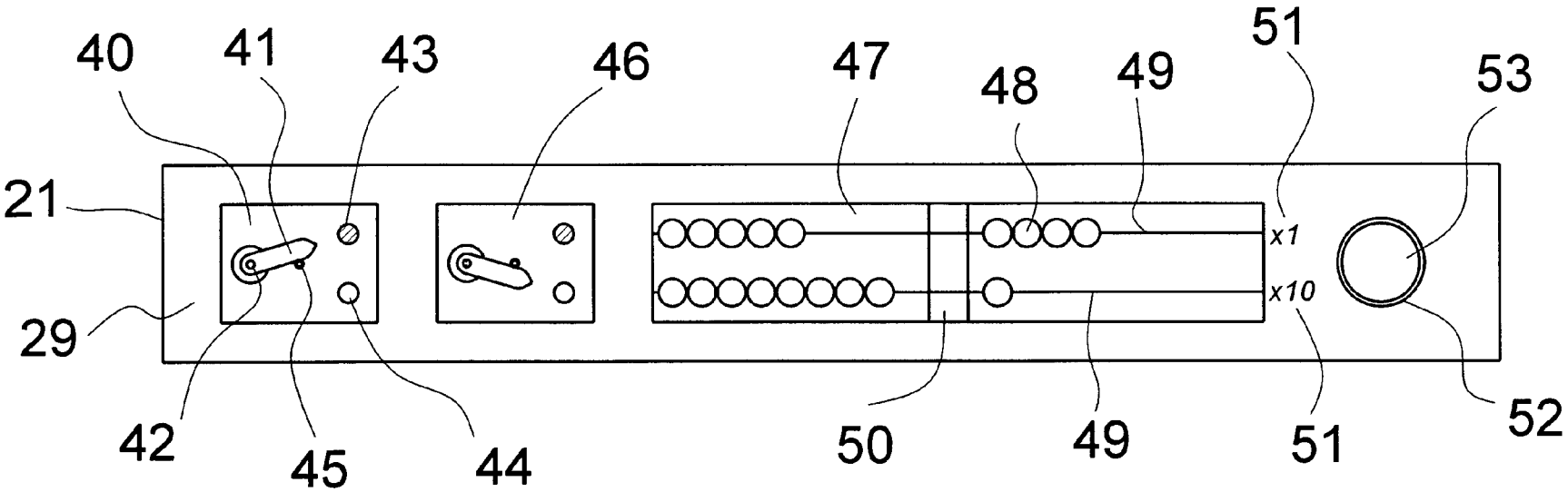
FIG. 9 is an end view of the retainer, showing means for displaying information relating to the game in progress.

Referring now to FIG. 9, there is shown one of the four peripheral edges 29 of the retainer frame 21 illustrating means for indicating which player has the next turn, the color and the net number of captured stones, and the intersection, if any, on which immediate play is forbidden because of an active "ko". At the left is a recessed area 40 within which is mounted a pointer 41 which can be moved about a pivot 42 so as to point to a small black circle 43 or to a small white circle 44, indicating which player has the next move. A detent 45 prevents the pointer from being moved inadvertently. An identical recess 46 with identical internal features indicates which player has lost a net excess of captured stones.

A third recess 47 contains two strings of beads 48 strung on heavy monofilament line 49 which is stretched taut and secured at both ends to the retainer frame 21 or to the ends of an insert which may be retained within the recess 47. A raised ridge 50 with rounded corners divides the horizontal space within the recess 47 into two equal parts. The diameter of the beads 48, the height and shape of the ridge 50 and the tension in the lines 49 are such that sufficient force is required to slide a bead over the ridge to assure that no bead will be shifted from one side to the other inadvertently. There are nine beads on each line. Markings 51 indicate that each bead to the right of the ridge on the top line represents one stone and each such bead on the bottom line represents ten stones. Hence, the configuration shown in FIG. 9 indicates that an excess of fourteen white stones have been captured. The largest total that can be represented by the two lines of beads is ninety-nine; far fewer than that would be an adequate reason for white to resign the game.

An alternative means of indicating the net number of captured stones could be provided by the use of a truncated abacus, having only two columns and requiring a total of only ten beads. The means described above, however, is a better fit in the space available and is somewhat easier to read—particularly for players who may not be familiar with the use of an abacus.

A fourth recess 52, at the far right in FIG. 9, provides a space for storing a thin disk 53 having the same diameter as a normal playing stone and being of a contrasting color, preferably red. If there is an intersection on the playing board on which immediate play is forbidden because of an active "ko", this disk can be removed from its recess and placed on the forbidden intersection before the retainer is placed over the playing board, to indicate the location of the forbidden intersection. The disk is, preferably, made of magnetic material and is retained in its recess by a small magnet attached to the retainer frame 21 and projecting from the bottom of the recess 52 so that pressure near the edge of the disk tilts it to permit it to be grasped and removed easily.

The cylindrical projections 23, 24 which serve as pegs in the retainer 20 need not necessarily be of circular cross-section. (Note that it is a . . . right circular cylinder. "Cylinder", however, is defined as: "the surface traced by a straight line moving parallel to a fixed straight line and intersecting a fixed planar closed curve". That fixed planar closed . . . right circular cylinder.)

Assuming the use of pegs of circular cross-section, there are a limited range of permissible diameters. For standard stones and playing board, with standard spacing of the horizontal and vertical lines marked on the board, the maximum diameter of pegs which will fit into the spaces 15 among the stones is about 10 millimeters. If the length of the pegs is adequate to accommodate the thickest stones that may be in use, then the diameter of the pegs cannot be less than about 3 millimeters or the thinnest of the stones that may be in use, if tipped into a diagonal position, can escape between vertically adjacent pegs. A peg diameter of 5 millimeters, or about three-sixteenths of an inch, will assure that the red "ko" marker as well as the playing stones will be reliably retained in their proper positions.

Referring to FIG. 2, it might be practicable to fabricate the frame 21, top 22, and pegs 23, 24 as a single integral cast or molded piece, leaving only the latches 25 and pivots 26 to be assembled to it. However, for aesthetic as well as practical reasons, it is preferable for the frame 21 to be a separate assembly made of wood—preferably a fine hardwood such as mahogany, walnut, chestnut, etc.—finished to be consonant with fine furniture and with protective and decorative brass overlays (not shown) applied at the exterior corners.

This completes the description of the embodiment of the invention illustrated herein. However, many modifications thereof will be apparent to persons skilled in the art without departing from the spirit and scope of this invention. Accordingly, it is intended that the invention not be limited to the particular details of the embodiment described herein except as defined by the appended claims.

What is claimed is:

1. The combination of a retainer and a Go playing board having a bottom surface, four outside edges, and a playing surface with intersecting lines marked thereupon and with playing pieces disposed thereupon; said retainer comprising four peripheral edges and a generally planar top with a plurality of distinct but not altogether separate cells having the same number and spacial arrangement as the intersections of said lines marked on said playing surface, being so configured that when said retainer is secured over said playing board on which a game is in progress, each said playing piece on said playing surface is constrained to remain in its proper position, but with freedom of position subject to said constraint, and is, in particular, free to slightly overlap adjacent said playing pieces.

2. The combination of a retainer and a Go playing board having a bottom surface, four outside edges, and a playing surface with intersecting lines marked thereupon and with playing pieces disposed thereupon; said retainer comprising four peripheral edges and a generally planar top with a plurality of distinct cells having the same number and spacial arrangement as the intersections of said lines marked on said playing surface, each said cell being adapted to receive and substantially restrain one of said playing pieces, whereby when said retainer top is secured over said Go board playing surface on which a game is in progress, all of said playing pieces are reliably retained in their respective positions on said playing surface.

3. The combination of the retainer and Go playing board of claim 2, further comprising means for indicating the intersection, if any, of said lines marked on said playing surface on which the play of the next playing piece is forbidden by reason of an active "ko".

4. The combination of the retainer and Go playing board of claim 3, wherein said means for indicating said forbidden intersection comprises a disk having substantially the same diameter as said playing pieces and being of a contrasting color, preferably red, said disk being retained in a recess in one of said four peripheral edges of said retainer, said disk being readily removable from said recess for placement on said forbidden intersection.

5. The combination of a retainer and a Go playing board having a bottom surface, four outside edges, and a playing surface with intersecting lines marked thereupon and with playing pieces disposed thereupon, said retainer comprising:

(a) a frame;

(b) a generally planar sheet having a top surface, a bottom surface, and four peripheral edges enclosed and contained by said frame;

(c) a plurality of cylindrical members disposed upon said planar sheet bottom surface, each said cylindrical member having a distal end projecting perpendicularly from said bottom surface, and having a length slightly greater than the maximum thickness of said playing pieces;

(d) a plurality of half-cylindrical members disposed upon said planar sheet bottom surface adjacent to said peripheral edges and projecting perpendicularly from said bottom surface, having a length substantially equal to that of said cylindrical members and having a cross section substantially equivalent to one part of the cross section of said cylindrical members, said cross section being divided by a straight line into two equal parts; and (e) securing means for detachably mounting said retainer to said playing board whereby when said cylindrical member distal ends are brought near to, or into communication with, said playing surface, said playing pieces are constrained among said plurality of cylindrical members such that the configuration of said playing pieces upon said playing surface is maintained during storage and transport of said playing board with said retainer.

6. The combination of the retainer and Go playing board of claim 5, wherein said plurality of cylindrical members are 324 in number and are configured in a substantially equidistant eighteen by eighteen array to form rows and columns of cells therebetween, and said plurality of half-cylindrical members are 72 in number, said half-cylindrical members being positioned at the ends of each row and column of said cylindrical members to form peripheral rows and columns of cells.

7. The combination of the retainer and Go playing board of claim 5, wherein said pluralities of cylindrical and half-cylindrical members are integrally formed with said planar sheet.

8. The combination of the retainer and Go play board of claim 5, wherein said securing means comprises recesses extending through at least two opposing members of said retainer frame, a latch having a securing end and a pivot end pivotably secured within each said retainer frame recess, and complementary recesses in corresponding peripheral edges of said playing board adapted to receive said latches, whereby when said retainer is brought into place over said playing board, each said latch may be pivoted such that said securing end is substantially moved into said playing board complementary recess, thereby securing said retainer over said playing board playing surface.

* * * * *